United States Patent [19]

Razzore

[11] Patent Number: 4,966,277

[45] Date of Patent: Oct. 30, 1990

[54] BASKET FRAME

[76] Inventor: Andrew Razzore, 98 Norwalk Ave., Staten Island, N.Y. 10314

[21] Appl. No.: 392,000

[22] Filed: Aug. 10, 1989

[51] Int. Cl.[5] ..... A65D 5/50

[52] U.S. Cl. ..... 206/44 K; 206/45; 206/45.14; 206/45.25

[58] Field of Search ..... 206/44 K, 45, 423, 45.25, 206/45.14

[56] References Cited

U.S. PATENT DOCUMENTS

| | | | |
|---|---|---|---|
| 2,612,989 | 10/1952 | Harrison | 206/45 |
| 3,167,179 | 1/1965 | Goldstein | 206/45 |
| 3,298,512 | 1/1967 | Crang | 206/423 |
| 3,857,747 | 12/1974 | Bitecola | 206/423 |
| 4,508,223 | 4/1985 | Catrambonz | 206/423 |

FOREIGN PATENT DOCUMENTS

| | | | |
|---|---|---|---|
| 0311174 | 4/1989 | European Pat. Off. | 206/423 |

*Primary Examiner*—Joseph Man-Fu Moy

*Attorney, Agent, or Firm*—Howard M. Schwinger

[57] ABSTRACT

An extension for a basket, the extension being formed from a sheet of pliant, self-supporting material, the sheet being bendable to the point where its opposite edges meet, cooperating means at the edges for holding the bent structure together, the structure having pockets formed therein to hold objects, one end of the structure being insertable in a basket, the other end extending upwardly therefrom.

3 Claims, 2 Drawing Sheets

BASKET FRAME

This invention relates to baskets and more particularly to the so-called gift basket which traditionally contains fruit, cheeses, jellies and the like piled one upon the other.

BACKGROUND OF THE INVENTION

It is rather difficult and somewhat time consuming to create the traditional gift basket wherein fruit and cheese, etc are arranged pyramidally above a basket and spaced by paper stuffed within the interstices created thereby, the whole assemblage being held together by a sheet of colored cellophane and finished off with a bow on top.

At holiday time when demand for such baskets runs high it is difficult to train people to make up these baskets and this limits production in the small stores which traditionally specialize in this type of product.

Additionally, if fruit is not properly stacked spoilage is accelerated with dire results.

OBJECTS OF THE INVENTION

It is thus a primary object of the present invention to provide a form for facilitating the fabrication of such baskets It is yet another object of the present invention to provide a material for the fabrication of gift baskets which can be readily stacked, stored, packed and shipped.

It is another important object of the present invention to provide a material for fabricating such baskets which will deter fruit spoilage.

These and other objects are realized by a an extension for a basket, the extension being formed from a sheet of pliant, self-supporting material, the sheet being bendable to the point where its opposite edges meet, cooperating means at the edges for holding the bent structure together, the structure having pockets formed therein to hold objects, one end of the structure being insertable in a basket, the other end extending upwardly therefrom.

Other objects and advantages of the present invention will become apparent from a reading of the following specification taken in connection with the accompanying drawing wherein:

FIG. 1 is a plan view of a preferred embodiment of the invention,

FIG. 2 is an elevational view of a fruit basket assemblage constructed in accordance with the present invention, FIG. 3 is a top view of FIG. 2 with the closure member, FIG. 4 is a top view of FIG. 2 without the closure member, FIG. 5 is a sectional view taken on line 5—5 of Fig 4, in the direction of the arrows, and FIG. 6 is a sectional view taken on line 6-6 of FIG. 2, in the direction of the arrows.

DETAILED DESCRIPTION OF THE DRAWING

Figure 1:
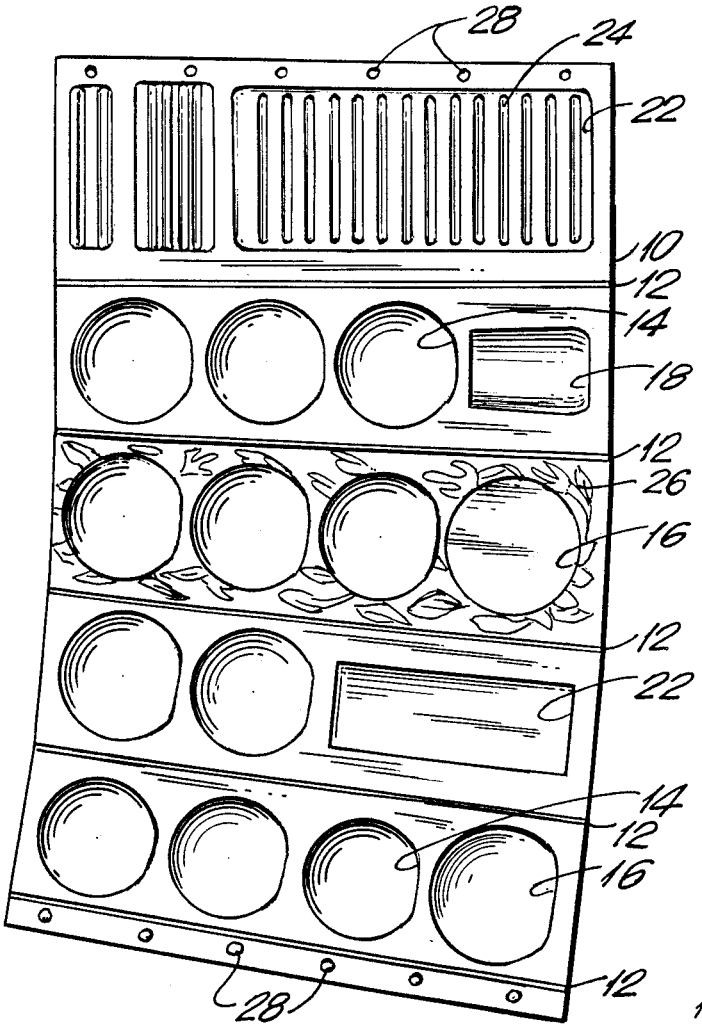

An embodiment of sheet material in accordance with the present invention is indicated in Fig 1 by numeral 10. Ideally, the sheet material should be of a self-supporting plastic and it should be foldable. Fold lines 12 are provided to aid in this respect. In this embodiment of the invention the plastic sheet is longer at one end than at the other to give the ultimate form a tapered appearance when the gift basket is assembled, as is shown in FIG. 2.

Various recesses are formed in sheet 12 to serve a variety of purposes. For example, the recesses indicated as 14 are for fruit such as apples, oranges, and pears, all fruit being indicated by numeral 15. Larger recesses numbered 16 are for larger fruit such as grapefruit. It will be noted that by virtue of these recesses the individual pieces of fruit are held apart from each other to retard spoilage. Other recesses such as 18, 20 and 22 may hold packaged cheeses, cans of ham, jars of jellies etc. Ribs 24 are provided for strength. Decoration such as at 26 may be provided.

At either end of sheet 10 a series of small recesses 28 are provided. As may be best seen in FIG. 6 the walls 30 of these recesses cooperate with one another to act as fasteners to hold the sheet in its folded position in basket 36. This is best seen in FIGS. 3 through 6.

Figure 2:
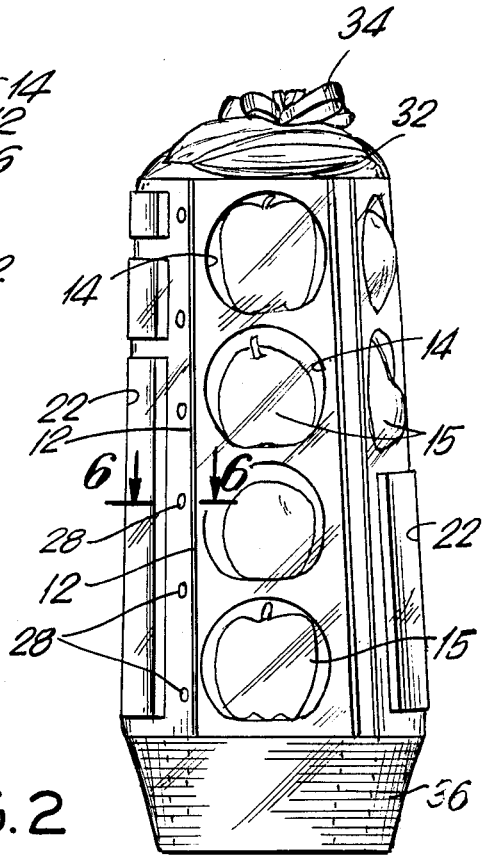
Figure 3:
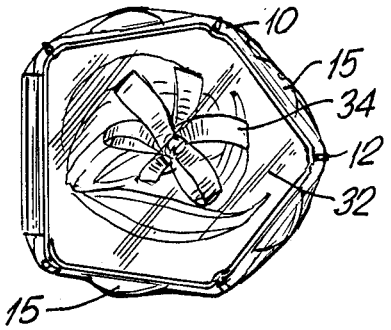
Figure 4:
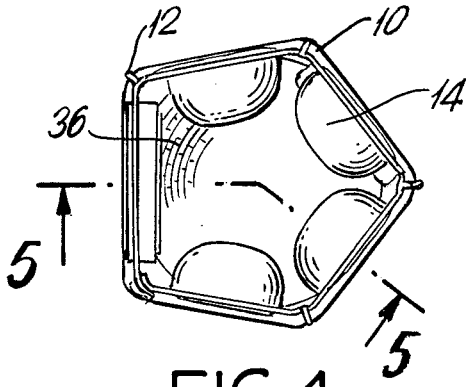
Figure 5:
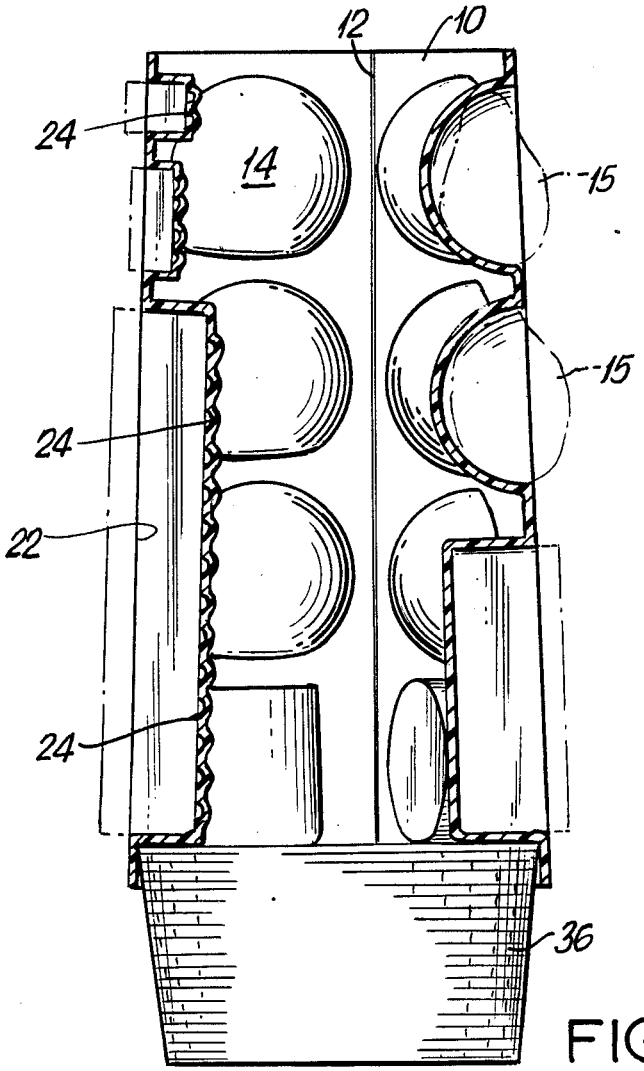
Figure 6:
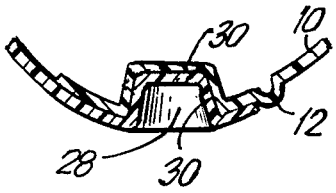

The form may be capped by a closure member 32 as shown in FIGS. 2 and 3. The closure member may be provided with a decorative ribbon 34. Closure member 32 is supported on the top end of form 12 by the walls forming recesses 14 as is shown in FIG. 4.

It should be realized that the embodiments herein described are only representative of the invention and it is not intended to limit the invention to these particular embodiments as the invention encompasses all embodiments falling with the spirit and scope of the appended claims. For example, the number of panels formed by sheet 10 is arbitrary as is the shape and number of the recesses and the material chosen for the sheet as long as it is self-supporting.

I claim:

1. A tubular extension for a basket formed from a sheet of pliant, self-supporting material, said sheet being bent to the point where its opposite edges meet to form a tube, cooperating means at the edges for holding the tube together, said tube having recesses formed in its wall to hold objects, one end of said tube being insertable in a basket, the other end extending upwardly therefrom.

2. A tubular extension for a basket formed from a sheet of pliant, self-supporting material, said sheet being provided with a series of transverse fold lines so that the sheet can be readily folded into a plurality of panels, said sheet being folded so that the edges of its end panels meet to form a tube, cooperating means at said edges for holding said tube together, said tube having recesses formed in its wall to hold objects, one end of said tube being insertable in a basket, the other end for extending upwardly therefrom.

3. A tubular extension for a basket formed from a sheet of pliant, self-supporting material, one side of said sheet being longer than its opposite side, said sheet being provided with a series of transverse fold lines so that the sheet can be readily folded into a plurality of panels, said sheet being folded so that the edges of its end panels meet to form a tube, cooperating means at said edges for holding said tube together, said tube having recesses formed therein to hold objects, one end of said tube being insertable in a basket, said end being formed from the longer side of said sheet, the other end for extending upwardly therefrom, a closure for said upper end, said closure resting upon the the walls of the the uppermost recesses within the tube.

* * * * *